United States Patent [19]

Henderson et al.

[11] Patent Number: 4,810,314

[45] Date of Patent: Mar. 7, 1989

[54] ENHANCED CORROSION RESISTANT AMORPHOUS METAL ALLOY COATINGS

[75] Inventors: Richard S. Henderson, Solon; Gary A. Shreve, Garfield Hts.; Michael A. Tenhover, Solon, all of Ohio

[73] Assignee: The Standard Oil Company, Cleveland, Ohio

[21] Appl. No.: 138,789

[22] Filed: Dec. 28, 1987

[51] Int. Cl.[4] ..... C22C 27/06

[52] U.S. Cl. ..... 148/403

[58] Field of Search ..... 148/403, 423; 420/428

[56] References Cited

U.S. PATENT DOCUMENTS

| | | |
|---|---|---|
| 3,036,251 | 4/1961 | Brenner . |
| 3,172,759 | 2/1964 | Kaarlela . . |
| 3,239,335 | 3/1966 | Carlson et al. . |
| 3,246,980 | 4/1966 | Stern . |
| 3,497,332 | 2/1970 | Donnelly et al. . |
| 3,644,863 | 2/1972 | Tsuei . |
| 3,829,969 | 8/1974 | Fischbein et al. . |
| 3,929,474 | 12/1975 | Ingersoll . |
| 4,195,988 | 4/1980 | Ito . |
| 4,261,744 | 4/1981 | Boyajian . |
| 4,319,877 | 3/1982 | Boyajian . |
| 4,382,909 | 5/1983 | Zwingmann . |
| 4,432,794 | 2/1984 | Holleck . |
| 4,701,226 | 10/1987 | Henderson et al. . |

OTHER PUBLICATIONS

"Corrosion and Electrochemical Behavior of Chromium-Noble Metal Alloys", J. Electrochem. Soc., 1961, vol. 108, No. 9, pp. 836-841, Green et al.

Journal of Non-Crystalline Solids, Naka et al., vol. 31, p. 355, 1979.

Annual Review of Materials Science, T. Masumoto et al., vol. 8, p. 215, 1978.

Corrosion, R. B. Diegel et al., vol. 32, p. 155, 1976.

Extremely High Corrosion Resistance in Amorphous CR-B Alloys, J. Appl. Phys., vol. 54, No. 10, p. 5705, 1983, Ruf et al.

Glassy Metals: Magnetic, Chemical and Structural Properties, Chapter 8, CRC Press, Inc., 1983.

*Primary Examiner*—R. Dean

*Attorney, Agent, or Firm*—Sue E. Phillips; Joseph G. Curatolo; Larry W. Evans

[57] ABSTRACT

The present invention relates to an amorphous metal alloys of the formula:

$$Cr_aX_bM_c$$

wherein

X is at least one element selected from the group consisting of Pt, Pd, Ir, Rh and Ru;

M is at least one element selected from the group consisting of P, B, N, C, As, Sb and S; and wherein a ranges from about 0.60 to abotu 0.96;

b ranges from greater than zero to about 0.01;

c ranges from about 0.04 to about 0.40; and with the provisor that a+b+c equals 1.00.

7 Claims, No Drawings

ENHANCED CORROSION RESISTANT AMORPHOUS METAL ALLOY COATINGS

FIELD OF THE INVENTION

The present invention relates to amorphous chromium alloys that exhibit excellent corrosion resistance in strongly oxidizing and nonoxidizing environments.

BACKGROUND OF THE INVENTION

The tendency of metals to corrode has long been a recognized concern. By corrosion is meant the degradation of a metal by the environment by either chemical or electrochemical processes. A large number of crystalline alloys have been developed with various degrees of corrosion resistance in response to various environmental conditions under which the alloys must perform. As examples, stainless steel contains nickel, chromium and/or molybdenum to enhance its corrosion resistance. Glass and metals such as platinum, palladium, and tantalum are also known to resist corrosion in specific environments. The shortcomings of such materials lie in that they are not entirely resistant to corrosion and that they have restricted uses. Tantalum and glass resist corrosion in acidic environments but are rapidly corroded by hydrogen fluoride and strong base solutions.

The corrosion resistance of an alloy is found generally to depend on the protective nature of the surface film, generally a passive oxide film. In effect, a film of a corrosion product functions as a barrier against further corrosion.

"Corrosion and Electrochemical Behavior of Chromium-Nobel Metal Alloys", *J. Electrochem. Soc.*, 1961, Vol. 108, No. 9, pp 836–841, by Greene et al., presents a discussion of alloying chromium with small amounts of platinum, palladium, indium, rhodium, ruthenium, or osmium to produce crystalline alloys with improved corrosion resistance. These crystalline alloys were tested in boiling $H_2SO_4$, HCl and $HNO_3$, and demonstrated improved corrosion resistance in dilute nonoxidizing acids.

In recent years, amorphous metal alloys have become of interest due to their unique characteristics. While most amorphous metal alloys have favorable mechanical properties, they tend to have poor corrosion resistance. An effort has been made to identify amorphous metal alloys that couple favorable mechanical properties with corrosion resistance. Amorphous ferrous alloys have been developed as improved steel compositions. Binary iron-metalloid amorphous alloys were found to have improved corrosion resistance with the addition of elements such as chromium or molybdenum, M. Naka et al, *Journal of Non-Crystalline Solids*, Vol. 31, page 355, 1979. Naka et al. noted that metalloids such as phosphorous, carbon, boron and silicon, added in large percentages to produce the amorphous state, also influenced its corrosion resistance.

T. Masumoto and K. Hashimoto, reporting in the *Annual Review of Material Science*, Vol. 8, page 215, 1978, found that iron, nickel and cobalt-based amorphous alloys containing a combination of chromium, molybdenum, phosphorus and carbon were found to be extremely corrosion resistant in a variety of environments. This has been attributed to the rapid formation of a highly protective and uniform passive film over the homogeneous, single-phase amorphous alloy which is devoid of grain boundaries and most other crystalline defects.

Many amorphous metal alloys prepared by rapid solidification from the liquid phase have been shown to have significantly better corrosion resistance than their conventionally prepared crystalline counterparts, as reported by R. B. Diegel and J. Slater in *Corrosion*, Vol. 32, page 155, 1976. Researchers attribute this phenomena to three factors: Structure, such as grain boundaries and dislocations; chemical composition; and homogeneity, which includes composition fluctuation and precipitates.

Ruf and Tsuei reported amorphous Cr-B alloys having extremely high corrosion resistance, "Extremely High Corrosion Resistance in Amorphous Cr—B Alloys", Journal of Applied Physics, Vol. 54 No. 10, p. 5705, 1983. Amorphous films of Cr—B alloys containing from about 20 to 60 atomic percent boron were formed by rf sputtering. At room temperature, Ruf and Tsuei reported that in 12N HCl high corrosion resistance was observed only when boron as present in the amorphous alloy at between 20 and 40 atomic percent. Bulk polycrystalline Cr was reported to dissolve at about 700 millimeters/day in 12N HCl at room temperature.

A thorough discussion of the corrosion properties of amorphous alloys can be found in Glassy Metals: Magnetic, Chemical, and Structural Properties, Chapter 8, CRC Press, Inc., 1983. In spite of advances made to understand the corrosion resistance of amorphous metal alloys, few alloys have been identified that exhibit little or no corrosion under extremely harsh acidic and/or alkaline environments. Those few alloys which do exhibit such properties utilize expensive materials in the alloy composition and so are prohibitive for many applications where their properties are desired.

Amorphous metal alloys that have been studied for corrosion resistance and have been evaluated under relatively mild conditions, 1N–12N HCl, and at room temperature. However, under more severe conditions, such as 6.5N HCl at elevated temperatures, those amorphous metal alloys cited as having good corrosion resistance may not be suitable for use.

What is lacking in the field of amorphous metal alloys are economical alloy compositions that exhibit a high degree of corrosion resistance under severely corrosive conditions.

It is, therefore, one object of the present invention to provide amorphous metal alloy compositions having excellent corrosion resistance in oxidizing and nonoxidizing acid environments.

It is another object of the invention to provide such amorphous metal alloy compositions in a cost-effective manner.

These and other objects of the present invention will become apparent to one skilled in the art of the following description of the invention and in the appended claims.

SUMMARY OF THE INVENTION

The present invention relates to an amorphous metal alloy of the formula:

$$Cr_aX_bM_c$$

wherein

X is at least one element selected from the group consisting of Pt, Pd, Ir, Rh and Ru;

M is at least one element selected from the group consisting of P, B, N, C, As, Sb and S;

and wherein a ranges from about 0.60 to about 0.96;

b ranges from greater than zero to about 0.01;

c ranges from about 0.04 to about 0.40;

and with the proviso that a+b+c equals 1.00.

DETAILED DESCRIPTION OF THE INVENTION

The compositions described herein are substantially amorphous metal alloys. The term "substantially" is used herein in reference to the amorphous metal alloys indicates that the metal alloys are at least 50 percent amorphous as indicated by x-ray defraction analysis. Preferably, the metal alloy is at least 80 percent amorphous, and most preferably about 100 percent amorphous, as indicated by x-ray defraction analysis. The use of the phrase "amorphous metal alloy" herein refers to amorphous metal-containing alloys that may also comprise nonmetallic elements.

In accordance with the present invention there are provided catalytically enhanced amorphous alloy compositions having the ability to withstand corrosion under severely corrosive conditions. These amorphous metal alloys are generally represented by the empirical formula:

$$Cr_a X_b M_c$$

wherein

X is at least one element selected from the group consisting of Pt, Pd, Ir, Rh and Ru;

M is at least one element selected from the group consisting of P, B, N, C, As, Sb and S;

and wherein a ranges from about 0.60 to about 0.96;

b ranges from greater than zero to about 0.01;

c ranges from about 0.04 to about 0.40;

and with the proviso that a+b+c equals 1.00.

Each of these compositions, wherein the composition contains a relatively low percentage of the M, or metalloid component, exhibits excellent corrosion resistance under severe conditions, that is, a corrosion rate on the order of less than about 5 mm/yr when tested in refluxing 6.5N HCl.

The amorphous metal alloy compositions taught herein are different from most amorphous compositions in the literature that claim corrosion resistance in that the compositions herein are conspicuous in the absence of iron, nickel and cobalt as is taught in the literature. However, it is to be recognized that the presence of other elements as impurities in these amorphous metal alloy compositions is not expected to significantly impair the ability of the alloy to resist corrosion. Thus, trace impurities such as O, Te, Si, Al, Ge, Sn and Ar are not expected to be seriously detrimental to the preparation and performance of these materials.

The present invention contemplates the inclusion of metalloid elements, identified herein by the symbol M, that contribute not only to the corrosion resistance of the amorphous alloy, but may also provide other desirable properties such as wearability, and are essential to the formation and stability of the amorphous state of the alloy. The amount of metalloid incorporated in the alloy, and the particular metalloid element used is determined by the synthesis technique chosen to form the amorphous state. The choice of metalloid can be readily made by one skilled in the art.

The present invention further contemplates the inclusion in the alloy of noble metal elements, identified herein by the symbol X, which are essential to the resistance of the material to extremely corrosive environments. The presence of X in the amorphous alloys taught herein enhances the resistance of the alloys such that concentrated acids may be endured even at high temperatures. The noble metals employed further function to increase the passivation rate of the protective surface on the alloy by enhancing the dissolution of metalloid ions from the passive layer and consequently increasing the concentration of chromium cations in the passive layer. This passive layer is, in essence, a layer of corrosion which once formed inhibits further corrosion of the underlying material. Thus, the speed of or the rate of corrosion is important to the corrosion resistant property of the alloy.

The corrosion resistance of amorphous metal alloys having significantly higher metalloid contents than those taught herein have been reported as excellent. However, it has also been shown in U.S. Pat. No. 4,701,226, to our common assignee, and incorporated herein by reference, that greater metalloid content reduces the corrosion resistance of these materials, as compared to those alloys whose metalloid content is similar to that disclosed herein. The relative corrosion rates become evident when amorphous metal alloys are subjected to severely corrosive environments.

To insure the desired corrosion resistant properties of the amorphous metal alloy compositions now described, it is important to maintain the integrity of the amorphous state, and so it is not intended that these materials be exposed to an environment wherein the temperature of the alloy may reach or exceed its crystallization temperature.

The substantially amorphous metal alloys taught herein may exist as powders, solids or thin films. The alloys may exist separately or in conjunction with a substrate or other material. A coating of the amorphous metal alloy may be deposited onto a substrate to impart the necessary corrosion resistance to the substrate material. Such a physical embodiment of the amorphous metal alloy may be useful as a coating on the interior surface of a chemical reaction vessel, as a coating on structural metal exposed to sea water or other strongly corrosive environments and as a coating on the surface of pipelines and pumps that transport acidic and/or alkaline chemicals. The amorphous metal alloy, because of its inherent hardness, may also be fabricated into any shape, and used freestanding or on a substrate for applications in harsh environments.

The compositions taught herein can be prepared by any of the standard techniques for the synthesis of amorphous metal alloy materials. Thus, physical and chemical methods such as electron beam deposition, chemical reduction, thermal decomposition, chemical vapor deposition, ion cluster deposition, ion plating, liquid quenching, RF and DC sputtering may be utilized to form the compositions herein as well as the chemical vapor deposition method referred to hereinabove.

EXAMPLES

The following examples demonstrate the corrosion resistance of various amorphous metal alloy compositions. It is to be understood that these examples are utilized for illustrative purposes only, and are not intended, in any way, to be limitative of the present invention.

The samples described and evaluated below are prepared by RF sputtering in the following manner: A 2" research S-gun manufactured by Sputtered Films, Inc. was employed. As is known, DC sputtering can also be employed to achieve similar results. For each sample a glass substrate was positioned to receive the deposition of the sputtered amorphous metal alloy. The distance between the target and the substrate in each instance was about 10 cm. The thicknesses of the films were measured by a quartz crystal monitor located next to the deposition sight. The average film thickness was about 1000 Angstroms. Confirmation of film thickness was done with a Dektak II, a trade name of the Sloan Company.

Each sample was analyzed by X-ray diffraction to confirm the composition and to verify that the composition was amorphous. Samples to be evaluated were fully immersed into a magnetically stirred, aqueous environment in which it was to be tested. No attempt was made to remove dissolved oxygen from these solutions.

Each sample was maintained in its test environment for a period of time after which a corrosion rate could be measured. Generally, the alloy composition of each sample was about totally consumed in the test. The time each sample was tested varied as a function of the composition being tested and the test environment. Samples were exposed to the test environment for time periods ranging from several seconds to several hundred hours.

EXAMPLES 1-16

Several Cr-X and Cr-M-X compositions were tested under severe environment conditions: concentrated refluxing nitric acid, refluxing 6.5N hydrochloric acid and refluxing sulfuric acid. These compositions included chromium metal, amorphous chromium-metalloid alloys, crystalline chromium-platinum alloys, and crystalline and amorphous alloys of the general formula disclosed herein. The results of exposure of the various compositions to these environments is summarized in Table 1 below.

TABLE 1

Corrosion Rates of Chromium Alloy Compositions

| Example | Refluxing Composition | Corrosion Rate (mm/yr) Refluxing conc. $HNO_3$ | Refluxing 6.5 N HCl | Refluxing $H_2SO_4$ (30%) |
|---|---|---|---|---|
| 1 | Cr* | 0.075 | >10,000 | >10,000 |
| 2 | Cr + 1.0% Pt* | 12.5 | >1,000 | 0.55 |
| 3 | Cr + 0.1% Pt* | 9.0 | >1,000 | 0.55 |
| 4 | $Cr_{79}B_{21}/Pt^a$ | 0.56 | 1.25 | — |
| 5 | $Cr_{60}N_{40}/Pt^a$ | 0.53 | 1.85 | <0.005 |
| 6 | $Cr_{70}B_{30}$ | 0.45 | >10,000 | 0.35 |
| 7 | $Cr_{70}C_{30}$ | 0.001 | >10,000 | <0.01 |
| 8 | $Cr_{70}N_{29}Pt_{1.0}$* | 51.5 | >10,000 | — |
| 9 | $Cr_{70}C_{29}.Pt_{0.1}$* | 40.2 | >10,000 | — |
| 10 | $Cr_{70}Pt_{2.0}C_{28}$ | 1.50 | 0.009 | <0.010 |
| 11 | $Cr_{70}Pt_{0.1}C_{29.9}$ | 0.095 | 0.031 | <0.004 |
| 12 | $Cr_{70}Pt_{1.0}N_{29}$ | 0.25 | 0.025 | <0.003 |
| 13 | $Cr_{70}Pt_{0.1}N_{29.9}$ | 0.061 | 0.091 | <0.008 |
| 14 | $Cr_{70}Pt_{0.05}P_{29.95}$ | 0.081 | 0.09 | <0.005 |
| 15 | $Cr_{80}Pt_{0.05}C_{19.95}$ | 0.009 | 0.215 | <0.002 |
| 16 | $Cr_{70}Ru_{0.5}N_{29.5}$ | 0.027 | 0.98 | <0.005 |

*crystalline composition
[a]Pt sputtered on amorphous sample, >100 A
— measurement not taken As can be seen from Examples 1-3, 8-9 in the Table, crystalline chromium, crystalline chromium-platinum alloys, and crystalline chromium-metalloid-platinum compositions of the formula disclosed herein exhibit corrosion rates in excess of the corrosion rates exhibited by amorphous compositions of the general formula disclosed herein.

Examples 4 and 5 set forth the corrosion rates of chromium-metalloid alloys that have been sputter-coated with platinum. While the corrosion rate of Example 5 in refluxing $H_2SO_4$(30%) is comparable to the rates of compositions which fall within the disclosed formula, the corrosion rates of these two examples in refluxing concentrated $HNO_3$ and refluxing 6.5N HCl are much higher than those of the claimed compositions.

Examples 6 and 7 demonstrate the corrosion rates of chromium-metalloid compositions, which are in excess of the claimed compositions in refluxing 6.5N HCl, but comparable in the remaining test environments.

Examples 10 and 12 are chromium-metalloid-platinum compositions which contain an amount of platinum in excess of that specified herein. The corrosion rates in refluxing concentrated $HNO_3$ is considerably higher than that of the claimed compositions.

Examples 9 and 11-16 depict amorphous chromium-noble metal-metalloid alloys in accordance with the present invention that exhibited excellent corrosion rates in both oxidizing and nonoxidizing environments.

Thus it is seen that the compositions in accordance with the teachings herein exhibit excellent corrosion resistance to severely corrosive environments. Because they are amorphous these alloys may be expected to exhibit excellent wear resistance, and should be quite useful in environments in which resistance to both erosion and corrosion is needed.

Although several amorphous metal compositions have been exemplified herein, it will readily be appreciated by those skilled in the art that the other amorphous metal alloys encompassed in the teachings herein could be substituted therefore.

It is to be understood that the foregoing examples have been provided to enable those skilled in the art to have representative examples by which to evaluate the invention and that these examples should not be construed as any limitation on the scope of this invention. Inasmuch as the composition of the amorphous metal alloys employed in the present invention can be varied within the scope of the total specification disclosure, neither the particular components nor the relative amount of the components in the alloys exemplified herein shall be construed as limitations of the invention.

Thus, it is believed that any of the variables disclosed herein can readily be determined and controlled without departing from the spirit of the invention herein disclosed and described. Moreover, the scope of the invention shall include all modifications and variations that fall within that of the attached claims.

We claim:

1. An amorphous metal alloy of the formula is:

$$Cr_aX_bM_c$$

wherein

X is at least one element selected from the group consisting of:

Pt, Pd, Ir, Rh and Ru;

M is at least one element selected from the group consisting of P, B, N, C, As, Sb and S;

and wherein a ranges from about 0.69 to about 0.96;

b ranges from greater than zero to about 0.01;

c ranges from about 0.04 to about 0.40;

and with the proviso that a+b+c equals 1.00.

2. The amorphous metal alloy in accordance with claim 1 wherein said amorphous metal alloy is at least 50 percent amorphous.

3. The amorphous metal alloy in accordance with claim 1 wherein said amorphous metal alloy is at least 80 percent amorphous.

4. The amorphous metal alloy in accordance with claim 1 wherein said amorphous metal alloy is about 100 percent amorphous.

5. The amorphous metal alloy in accordance with claim 1 wherein said amorphous metal alloy is resistant to a strongly oxidizing corrosive environment.

6. The amorphous metal alloy in accordance with claim 1 wherein said amorphous metal alloy is resistant to a strongly reducing corrosive environment.

7. An amorphous metal alloy coating of the formula:

$$Cr_aX_bM_c$$

wherein

X is at least one element selected from the group consisting of

Pt, Pd, Ir, Rh and Ru;

wherein

M is at least one element selected from the group consisting of P, B, N, C, As, Sb and S;

and wherein a ranges from about 0.69 to 0.96;

b ranges from greater than zero to about 0.01;

c ranges from about 0.04 to about 0.40;

and with the proviso that a+b+c equals 1.00, formed by a process comprising depositing a film of said amorphous metal alloy on a substrate.

* * * * *